US010899135B2

(12) United States Patent
Johnson et al.

(10) Patent No.: US 10,899,135 B2
(45) Date of Patent: Jan. 26, 2021

(54) DROP-ON-DEMAND PRINTER WITH BOTTLE INK SUPPLY AND KEYED BOTTLE CAP

(71) Applicant: Entrust Corporation, Shakopee, MN (US)

(72) Inventors: Kyle Johnson, Shakopee, MN (US); Randy Jordan, Shakopee, MN (US); Brian O'Dell, Shakopee, MN (US); Daniel Sarkinen, Shakopee, MN (US)

(73) Assignee: ENTRUST CORPORATION, Shakopee, MN (US)

( * ) Notice: Subject to any disclaimer, the term of this patent is extended or adjusted under 35 U.S.C. 154(b) by 0 days.

(21) Appl. No.: 16/185,380

(22) Filed: Nov. 9, 2018

(65) Prior Publication Data

US 2019/0134986 A1 May 9, 2019

Related U.S. Application Data

(60) Provisional application No. 62/583,713, filed on Nov. 9, 2017.

(51) Int. Cl.

| | |
|---|---|
| ***B41J 2/175*** | (2006.01) |
| ***B41M 5/00*** | (2006.01) |
| ***B41J 2/04*** | (2006.01) |

(52) U.S. Cl.

CPC ..... *B41J 2/1754* (2013.01); *B41J 2/04* (2013.01); *B41J 2/1752* (2013.01); *B41J 2/17509* (2013.01); *B41J 2/17513* (2013.01); *B41J 2/17523* (2013.01); *B41J 2/17553* (2013.01); *B41M 5/0047* (2013.01)

(58) Field of Classification Search

CPC ..... B41J 2/1755

See application file for complete search history.

(56) References Cited

U.S. PATENT DOCUMENTS

| | | | |
|---|---|---|---|
| 2,218,308 | A | 6/1939 | Comer |
| D240,022 | S | 5/1976 | Laurizio |
| D241,018 | S | 8/1976 | Amicis |
| D244,027 | S | 4/1977 | Mooney |
| 4,825,054 | A | 4/1989 | Rust et al. |
| D301,550 | S | 6/1989 | Mobberley |

(Continued)

FOREIGN PATENT DOCUMENTS

| | | | |
|---|---|---|---|
| CN | 2728480 | Y | 9/2005 |

OTHER PUBLICATIONS

International Search Report and Written Opinion, International Patent Application No. PCT/US2018/059976, dated Mar. 12, 2019 (11 pages).

*Primary Examiner* — Shelby L Fidler

(74) *Attorney, Agent, or Firm* — Hamre, Schumann, Mueller & Larson, P.C.

(57) ABSTRACT

An ink bottle is mounted in a DOD printer with the ink bottle acting as an ink supply reservoir that supplies ink to a DOD print head. A unique cap is provided that is configured to be affixed to an end of the ink bottle via threads or the like. The cap can be provided with one or more mechanical keying features used to limit mounting of the cap and the bottle assembly to a correct receiver in the DOD printer. The cap can also be provided with a valve controlled ink passage that allows ink to flow out of the bottle through the cap and a valve controlled vent passage that allows air to enter the bottle through the cap.

17 Claims, 15 Drawing Sheets

(56) References Cited

U.S. PATENT DOCUMENTS

| | | | | |
|---|---|---|---|---|
| 5,266,781 | A | 11/1993 | Warwick et al. | |
| 6,022,101 | A | 2/2000 | Sabonis | |
| 6,695,205 | B1 | 2/2004 | Lundstrom et al. | |
| 6,783,067 | B2 | 8/2004 | Kreuter et al. | |
| 6,902,107 | B2 | 6/2005 | Shay et al. | |
| 6,963,351 | B2 | 11/2005 | Squires et al. | |
| D529,804 | S | 10/2006 | Lohrman | |
| 7,398,972 | B2 | 7/2008 | Schuller et al. | |
| D578,890 | S | 10/2008 | Swanson | |
| 7,434,728 | B2 | 10/2008 | Paulson et al. | |
| D642,467 | S | 8/2011 | Knutson | |
| D828,752 | S | 9/2018 | Ploeger | |
| D863,960 | S | 10/2019 | Johnson | |
| 2005/0011916 | A1* | 1/2005 | Battista | B41J 2/17509 222/576 |
| 2005/0151764 | A1* | 7/2005 | Grady | B41J 2/17509 347/7 |
| 2010/0265302 | A1 | 10/2010 | Laramie et al. | |
| 2012/0152976 | A1* | 6/2012 | Yoshida | B41J 2/17513 222/81 |
| 2013/0220984 | A1 | 8/2013 | Cronin et al. | |
| 2013/0293624 | A1* | 11/2013 | Lester | B41J 2/17513 347/19 |
| 2015/0102059 | A1* | 4/2015 | Santrach | B67D 7/0255 222/105 |
| 2016/0300128 | A1 | 10/2016 | Alvig et al. | |
| 2017/0228632 | A1 | 8/2017 | Knipp et al. | |
| 2017/0355191 | A1* | 12/2017 | Mizutani | B41J 2/17523 |

* cited by examiner

DROP-ON-DEMAND PRINTER WITH BOTTLE INK SUPPLY AND KEYED BOTTLE CAP

FIELD

This disclosure relates generally to drop-on-demand (DOD) printers that print on substrates. In one particular application of the described technology, this disclosure relates to card processing systems that utilize DOD printing with a DOD printer to print on plastic cards including, but not limited to, financial (e.g., credit, debit, or the like) cards, driver's licenses, national identification cards, business identification cards, gift cards, and other plastic cards.

BACKGROUND

The use of DOD printers that print ink on various substrates, including plastic cards, is known. In some DOD printers, the ink in the DOD printer is contained within a bulk tank. As the ink in the bulk tank runs low, the bulk tank needs to be refilled with ink. The ink that is used for refilling the bulk tank is often contained in bottles that are very similar in appearance to one another regardless of the color of ink they contain. The ink from a bottle is poured into the bulk tank to refill the bulk tank. However, the need to refill the bulk tank can lead to spillage of the ink. In addition, since the bottles containing the refill ink are similar in appearance to one another, an end user or technician tasked with refilling the bulk tank may grab the wrong bottle and pour the wrong color ink into the bulk tank.

SUMMARY

Systems, apparatus and methods are described herein relating to DOD printers and DOD printing, and simplifying the replacement of ink used in the DOD printer and thereby prevent errors that may occur in replenishing the ink used in the DOD printer. The DOD printer, as well as the systems, apparatus and methods described herein, can be used to print on any type of substrate. In one example implementation described and illustrated herein in detail, the substrates can be plastic cards which bear or are intended to bear personalized data unique to the intended cardholder and/or which bear or are intended to bear other card information. Examples of plastic cards can include, but are not limited to, financial (e.g., credit, debit, or the like) cards, driver's licenses, national identification cards, business identification cards, gift cards, and other plastic cards. Instead of plastic cards, the substrates may be passport pages that bear personalized data unique to the intended passport holder. However, the techniques and concepts described herein can be applied in other applications separate from security documents (plastic cards and passport pages) that bear personalized data.

The inks described herein can be any suitable ink used in DOD printing. When the substrate is a plastic card, the ink is suitable for use on the types of cards described herein, for example the ink can be an ultraviolet (UV) curable ink.

The DOD printer can have a single print head or a plurality of print heads. In addition, the DOD printer can perform monochromatic or multi-color printing. In one example of multi-color printing, five print heads can be provided. Each print head can be designated to print a specific color ink, such as cyan, magenta, yellow, black and white (CMYKW).

The DOD printer can be used in a card processing system that can process cards such as by printing on the cards using the DOD printer. In one embodiment, the card processing system may also include one or more of: reading data from and/or writing data to a magnetic stripe on the cards, programming an integrated circuit chip on the cards, emboss characters on the cards, indenting characters on the cards, laminating the cards, using a laser that performs laser processing such as laser marking on the cards, applying a topcoat to a portion of or the entire surface of the cards, checking the quality of personalization/processing applied to the cards, applying a security feature such as a holographic foil patch to the cards, and other card processing operations.

In one system described herein, an ink bottle is mounted in the DOD printer with the ink bottle acting as an ink supply reservoir that supplies ink to a DOD print head. The system can be any system that uses a DOD printer to print on a substrate, such as a card processing system that may also include one or more additional card processing mechanisms.

In another system described herein, a cap is provided that is configured to be affixed to an end of a bottle via suitable affixing means, such as by threads or other type of affixing means. The cap can be provided with one or more mechanical keying features used to limit mounting of the cap and the bottle assembly to a correct receiver in the DOD printer. For example, the mechanical keying feature can be formed by a plurality of bores formed in the cap that are configured to receive pins therein. The specific arrangement of the pins in select ones of the bores dictates whether or not the cap can be received by a particular receiver in the DOD printer.

The mechanical keying feature can also be formed by the shape of an outer periphery of the body of the cap, with the shape of the outer periphery being different for each cap. The receiver in the DOD printer would have a shape that corresponds to the shape of the cap body outer periphery so that only a cap body with the correct outer periphery shape can be mounted in the receiver.

The cap may also include other features in addition to or separate from the mechanical keying feature(s). For example, the cap may include a surface for mounting a radio frequency identification (RFID) tag, from which data can be read and/or data written to by a suitable reader/writer, for example mounted on the receiver.

The cap may include a quick-connect valve, for example a male quick-connect valve, that controls the flow of ink from the bottle through the cap, and a check valve adjacent to the quick-connect valve that provides venting by allowing air into the bottle through the cap. The quick-connect valve of the cap is intended to engage with a corresponding quick-connect valve, such as a female quick-connect valve, of the receiver, with the quick-connect valve in the cap automatically opening upon mounting of the cap and bottle assembly to its corresponding receiver.

The cap may include a cap liner on the interior thereof that is intended to interface and seal with an end of the bottle. The cap liner can be provided with one or more openings therethrough that are aligned with the quick-connect valve and the check valve in the cap. The opening(s) permits passage of ink and air through the cap liner.

In one embodiment, a card processing system is described herein and includes a card input that is configured to hold a plurality of cards to be processed, a card output that is configured to hold a plurality of processed cards, at least one of a magnetic stripe reading/writing system and an integrated circuit chip programming system between the card input and the card output, and a drop-on-demand card printer between the card input and the card output that is configured to print on a card using ultraviolet curable ink. The drop-on-demand card printer can include at least one drop-on-demand print head, an ink bottle mounted in the drop-on-demand card printer and fluidly connected to the at least one drop-on-demand print head, where the ink bottle has a neck defining an ink outlet, and the neck has an exterior surface with threads thereon. In addition, an ultraviolet curing station can be located between the card input and the card output, where the ultraviolet curing station is configured to cure ultraviolet curable ink applied to a card by the drop-on-demand card printer.

In another embodiment, a cap is described herein that is configured for connection to a threaded neck of a bottle. The cap can include a cap body having a first end and a second end, and a connection sleeve projecting from the first end. The connection sleeve includes an interior surface with threads thereon that are configured to engage with the threaded neck of the bottle. An ink passage extends through the cap body, with the ink passage having an ink passage inlet end formed in the first end within the connection sleeve and an ink passage outlet end in the second end. A quick-connect valve is in the ink passage that controls flow of ink through the ink passage from the ink passage inlet end to the ink passage outlet end. In addition, a vent passage extends through the cap body separate from the ink passage, with the vent passage having a vent passage inlet end formed in the second end and a vent passage outlet end in the first end within the connection sleeve. A check valve is in the vent passage that controls flow of air through the vent passage from the vent passage inlet end to the vent passage outlet end.

DRAWINGS

DETAILED DESCRIPTION

A cap is provided that is configured to be affixed to an end of an ink bottle that supplies ink for use in a DOD printer. The cap can be affixed to the ink bottle via any suitable affixing means, such as by threads or other type of affixing means. The cap can be provided with one or more mechanical keying features used to limit mounting of the cap and the bottle assembly to a correct receiver in the DOD printer. For example, the mechanical keying feature can be formed by a plurality of bores formed in the cap that are configured to receive one or more pins therein, and/or by the shape of the outer periphery of the cap body as described below. The specific arrangement of the pins in select ones of the bores dictates whether or not the cap can be received by a particular receiver in the DOD printer.

The cap may also include other features in addition to or separate from the keying feature(s). For example, the cap may include a surface for mounting an RFID tag, and data can be read from and/or written to the RFID tag by a suitable reader/writer, for example mounted on the receiver. The cap may also include a quick-connect valve, for example a male quick-connect valve, that controls the flow of ink from the bottle through the cap, and a check valve adjacent to the quick-connect valve that provides venting by allowing air into the bottle through the cap. The quick-connect valve of the cap is intended to engage with a corresponding quick-connect valve, such as a female quick-connect valve, of the receiver, with the quick-connect valve in the cap automatically opening upon mounting of the cap and bottle assembly to its corresponding receiver. The cap may also include a cap liner on the interior thereof that is intended to interface and seal with an end of the bottle. The cap liner can be provided with one or more openings therethrough that are aligned with the quick-connect valve and the check valve in the cap. The opening(s) permits passage of ink and air through the cap liner.

Figure 1:
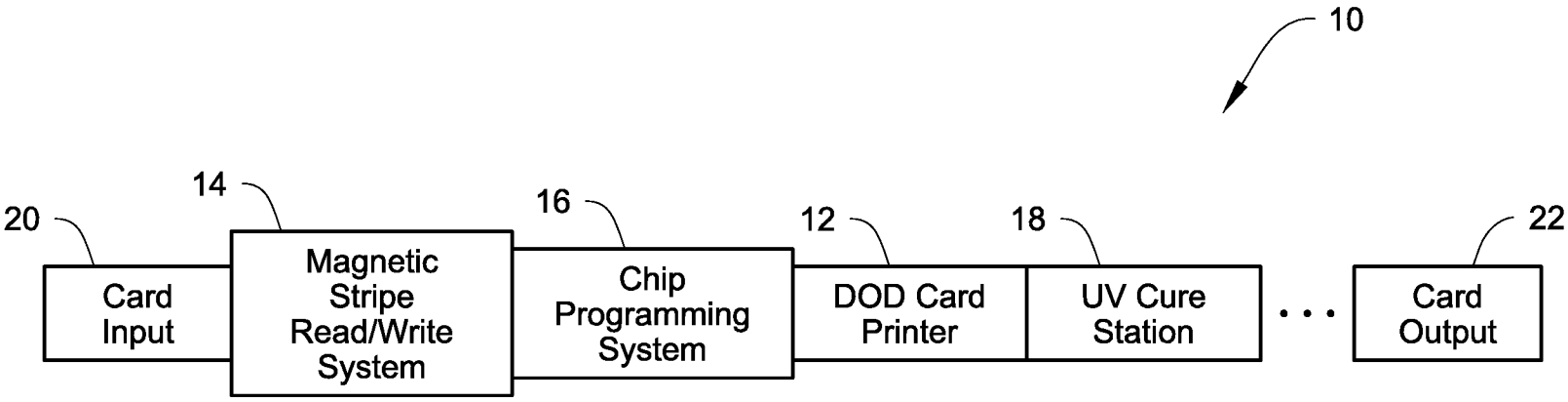
FIG. 1 illustrates an example system in the form of a card processing system in which the concepts described herein can be used.

The ink bottle, with or without the cap, can be mounted in the DOD printer with the ink bottle acting as an ink supply reservoir that supplies ink to a DOD print head of the DOD printer. The DOD printer can be part of any system that uses the DOD printer to print on a substrate. In one specific, non-limiting application, the DOD printer can be part of a card processing system 10 that may also include one or more additional card processing mechanisms. An example of the card processing system 10 is illustrated in FIG. 1. Although the ink bottle and cap concepts described herein will be described below with respect to a DOD card printer used in the card processing system 10, the ink bottle and cap concepts described herein can be used in other DOD printers used to print on substrates other than cards.

FIG. 1 illustrates an example of the card processing system 10. The system 10 is configured to process cards by at least printing on the cards using a DOD card printer 12 included in the system 10. The system 10 can also include at least one other card processing capability in addition to the printing by the DOD card printer 12. For example, the additional card processing can include a magnetic stripe read/write system 14 that is configured to read data from and/or write data to a magnetic stripe on the cards, and/or an integrated circuit chip programming system 16 that is configured to program an integrated circuit chip on the cards. When the DOD card printer 12 prints using ultraviolet (UV)

curable ink, a UV cure station 18 can also be provided. The construction and operation of the systems 14, 16, 18 is well known in the art. Magnetic stripe read/write systems and integrated circuit chip programming systems are disclosed, for example, in U.S. Pat. Nos. 6,902,107 and 6,695,205, and can be found in the MX family of central issuance systems available from Entrust Datacard Corporation of Shakopee, Minn. An example of a UV radiation applicator in a card printing system is the Persomaster card personalization system available from Atlantic Zeiser GmbH of Emmingen, Germany.

The cards to be processed as described herein include, but are not limited to, plastic cards which bear personalized data unique to the intended cardholder and/or which bear other card information. Examples of plastic cards can include, but are not limited to, financial (e.g., credit, debit, or the like) cards, driver's licenses, national identification cards, business identification cards, gift cards, and other plastic cards.

In the system 10 illustrated in FIG. 1, a card input 20 is provided that is configured to hold a plurality of cards waiting to be processed. Cards are fed one-by-one from the card input 20 into the rest of the system 10 where each card is individually processed. Processed cards are transported into a card output 22 that is configured to hold a plurality of the processed cards.

The card processing system 10 illustrated in FIG. 1 is a type of system that can be referred to as a central issuance card processing system. In a central issuance card processing system, the card input 20 and the card output 22 are generally at opposite ends of the system with the card processing mechanisms, such as the systems 12, 14, 16, 18 in FIG. 1, between the card input 20 and the card output 22. A central issuance card processing system is typically designed for large volume batch processing of cards, often employing multiple processing stations or modules to process multiple cards at the same time to reduce the overall per card processing time. Examples of central issuance card processing systems include the MX family of central issuance systems available from Entrust Datacard Corporation of Shakopee, Minn. Other examples of central issuance systems are disclosed in U.S. Pat. Nos. 4,825,054, 5,266,781, 6,783,067, and 6,902,107, all of which are incorporated herein by reference in their entirety. In one example, the card processing system 10 can process cards at a rate of at least about 500 cards per hour, or at least about 1000 cards per hour, or at least about 1500 cards per hour, or at least about 2000 cards per hour, or at least about 2500 cards per hour, or at least 3500 cards per hour.

In FIG. 1, the systems 12, 14, 16, 18 are downstream of the card input 20 and between the card input 20 and the card output 22. The sequence or arrangement of the systems 12, 14, 16, 18 relative to one another and relative to the card input 20 can be varied from the sequence that is illustrated in FIG. 1.

The system 10 may include additional card processing systems not illustrated in FIG. 1, which are well known in the art of card processing and which may also be located between the card input 20 and the card output 22. For example, the system 10 may include a card embossing system that is configured to emboss characters on the cards; an indenting system that is configured to indent characters on the cards; a laminator system that is configured to apply a laminate to the cards; a laser system that uses a laser to perform laser processing such as laser marking on the cards; a topcoat station that is configured to apply a topcoat to a portion of or the entire surface of the cards; a quality control station that is configured to check the quality of personalization/processing applied to the cards; a security station that is configured to apply a security feature such as a holographic foil patch to the cards; and other card processing operations. The additional card processing systems may be located anywhere in the system 10, such as, but not limited to, between the UV cure station 18 and the card output 22.

Figure 2:
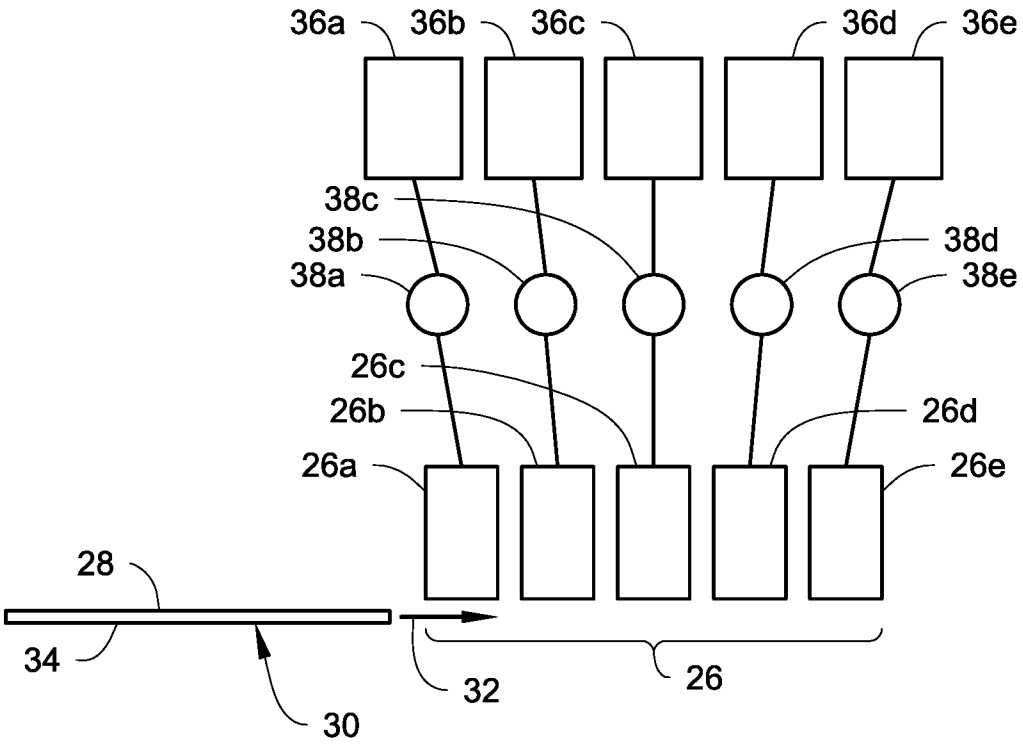
FIG. 2 is a schematic illustration of a DOD printer, such as the DOD card printer of FIG. 1, that can use the concepts described herein.

FIG. 2 is a schematic illustration of the DOD card printer 12. The DOD card printer 12 includes at least one DOD print head 26. The printing performed by the DOD card printer 12 can be monochromatic or multi-color. FIG. 2 shows five DOD print heads 26*a-e* arranged side-by-side to sequentially print onto a surface 28 of a card 30 as the card 30 is transported past the print heads 26*a-e*, for example underneath the print heads 26*a-e*, in the direction of the arrow 32. However, a smaller number of the DOD print heads 26, including one of the DOD print heads 26, or a larger number of the DOD print heads 26, can be used.

The DOD print heads 26*a-e* can print using any suitable ink or coating used in drop-on-demand printing and that is suitable for use on the types of cards described herein. For example, the ink can be a UV curable ink, a heat curable ink that can be cured by applying heat to the heat curable ink, or other ink or materials that can be deposited by DOD print heads. In the case of the five DOD print heads 26*a-e*, each DOD print head can print a specific color ink. For example, the DOD print head 26*a* can print cyan colored ink, the DOD print head 26*b* can print magenta colored ink, the DOD print head 26*c* can print yellow colored ink, the DOD print head 26*d* can print black ink, and the DOD print head 26*e* can print white ink. An example of a drop-on-demand printer that prints using UV curable ink in a card printing system is the Persomaster card personalization system available from Atlantic Zeiser GmbH of Emmingen, Germany. If printing on the opposite surface 34 of the card 30 is required, a card flipper or card reorienting mechanism (not shown) can be located in the system 10 to flip or rotate the card 30 180 degrees so that the surface 34 now faces upward and the surface 28 faces downward, and the card 30 is then transported back upstream of the print heads 26*a-e* to print on the surface 34. Examples of card flippers are disclosed in U.S. Published Application No. 2013/0220984 and U.S. Pat. No. 7,398,972 the entire contents of each are incorporated herein by reference. In other embodiments, a card flipper followed by a second DOD card printer could be provided in order to print on both sides of the card. This would eliminate the need to transport the card 30 back upstream of the print heads 26*a-e* of the single DOD card printer.

The specific construction and operation of the print heads 26*a-e* is well known and can be identical to the construction and operation of DOD print heads known in the art. The DOD print heads each includes a bottom surface that faces downward toward the card to be printed on, and a nozzle plate, through which ink is ejected, is provided on the bottom surface.

Still referring to FIG. 2, ink to be ejected from each print head 26*a-e* is supplied from a respective ink supply 36*a-e* corresponding to each print head 26*a-e* via a respective pump 38*a-e* that pumps the ink from the respective ink supply 36*a-e* to the respective print head 26*a-e*. The ink supplies 36*a-e* can be substantially identical in construction to one another and can have a configuration as described in detail below with respect to FIGS. 3-10. The pumps 38*a-e* can be any suitable type of pump, for example diaphragm pumps, for pumping the ink from the ink supplies 36*a-e*.

As described in further detail below, each ink color for the ink supplies 36*a-e* comes in a separate bottle from the ink supplier, and the bottles may be substantially identical in appearance to one another. A system is described below whereby the bottles are mounted in the DOD card printer 12 and are used as the ink supplies. However, because the bottles may be substantially identical in appearance, this can lead to an end user or other personnel mounting an incorrect bottle containing an incorrect color ink at an incorrect location in the DOD card printer 12. To prevent such errors, as described further below, the caps that come with the bottles are removed, and a unique cap is secured to each of the bottles. The unique caps are designed to ensure that only the correct bottle containing the correct color ink can be mounted at the correct location in the DOD card printer 12 to supply the correct ink to the correct print head 26*a-e*.

Figure 3:
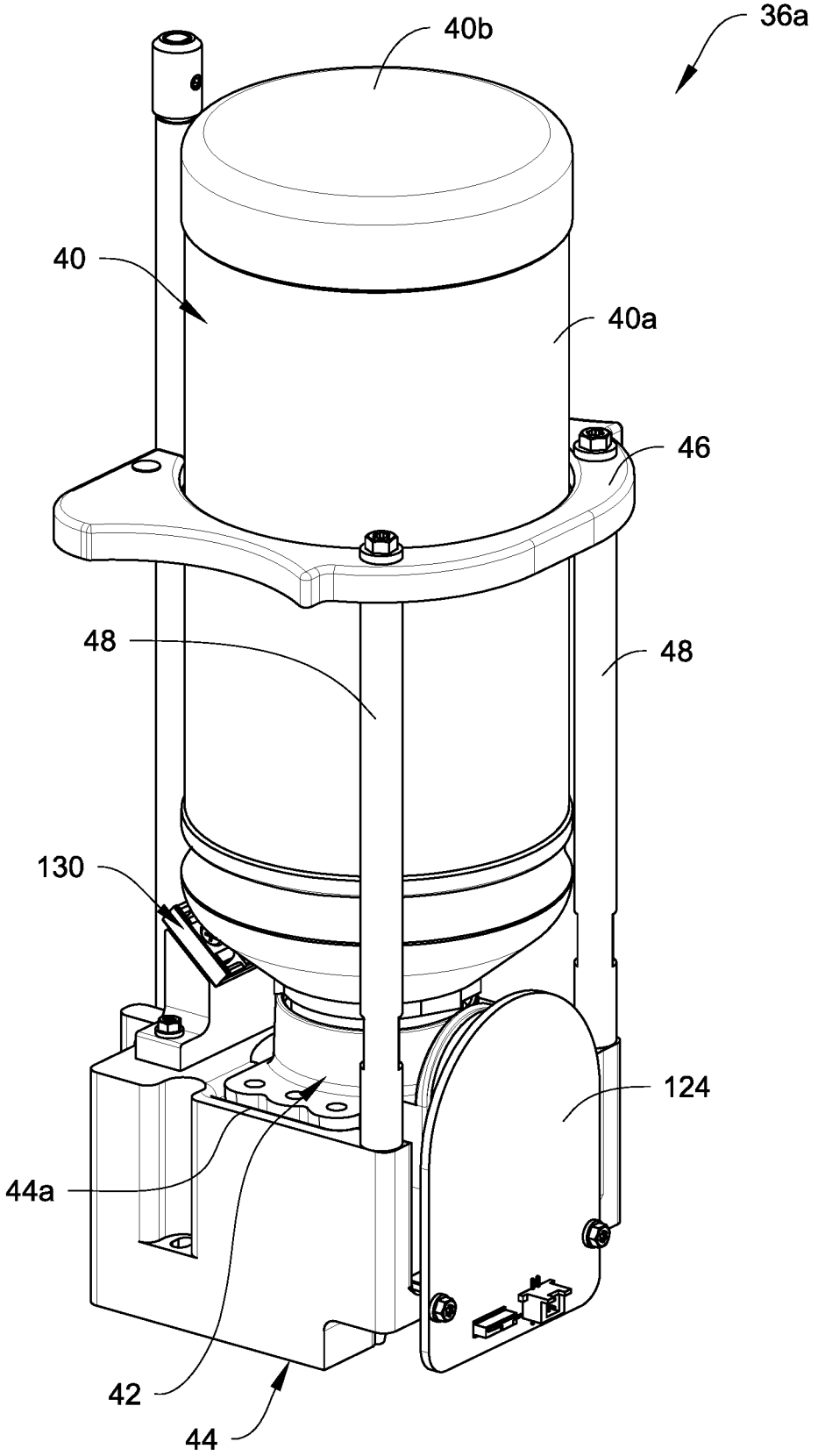
FIG. 3 is a perspective view of one cap and bottle assembly mounted in a receiver of the DOD printer.
Figure 4:
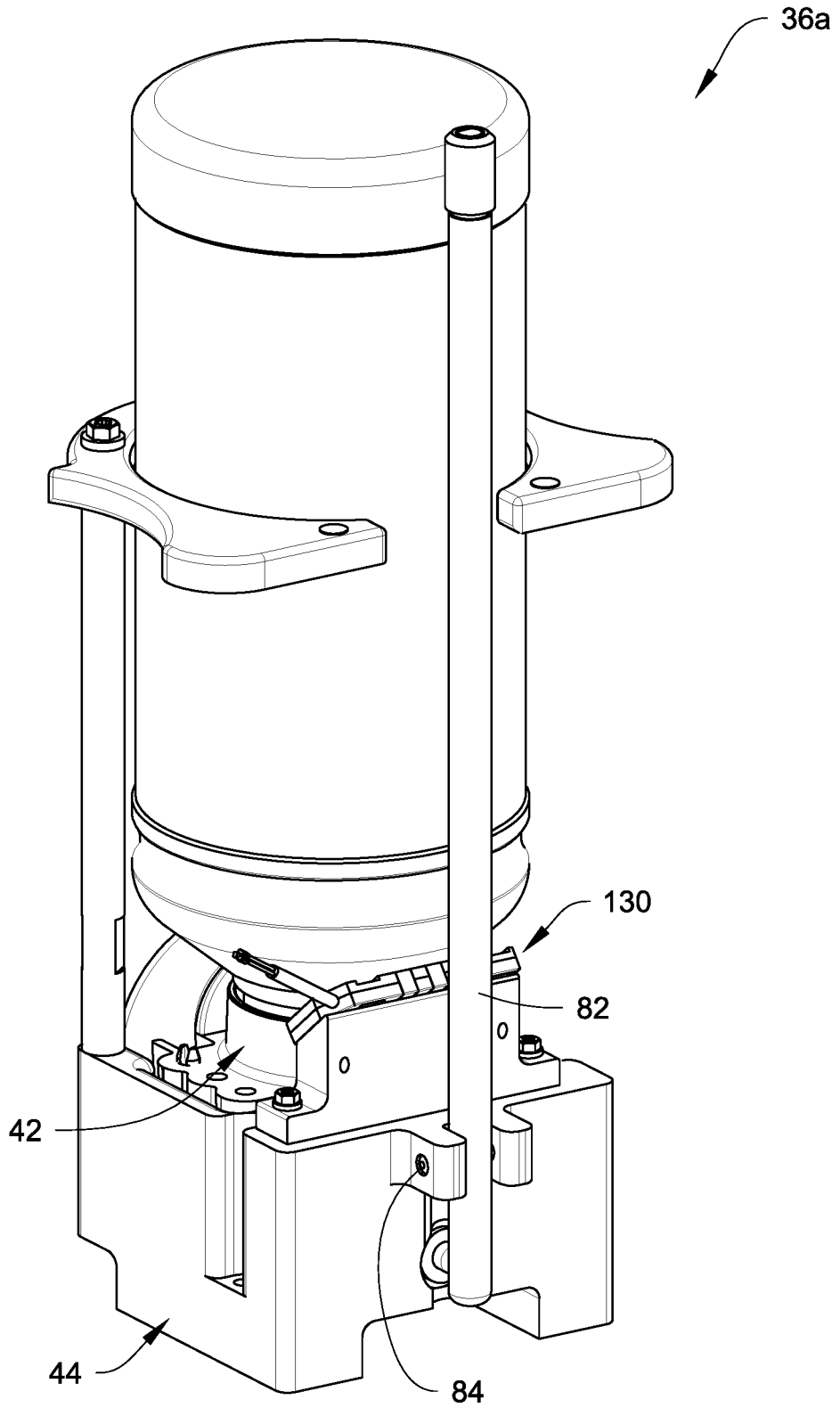
FIG. 4 is another perspective view of the cap and bottle assembly and receiver of FIG. 3.
Figure 5:
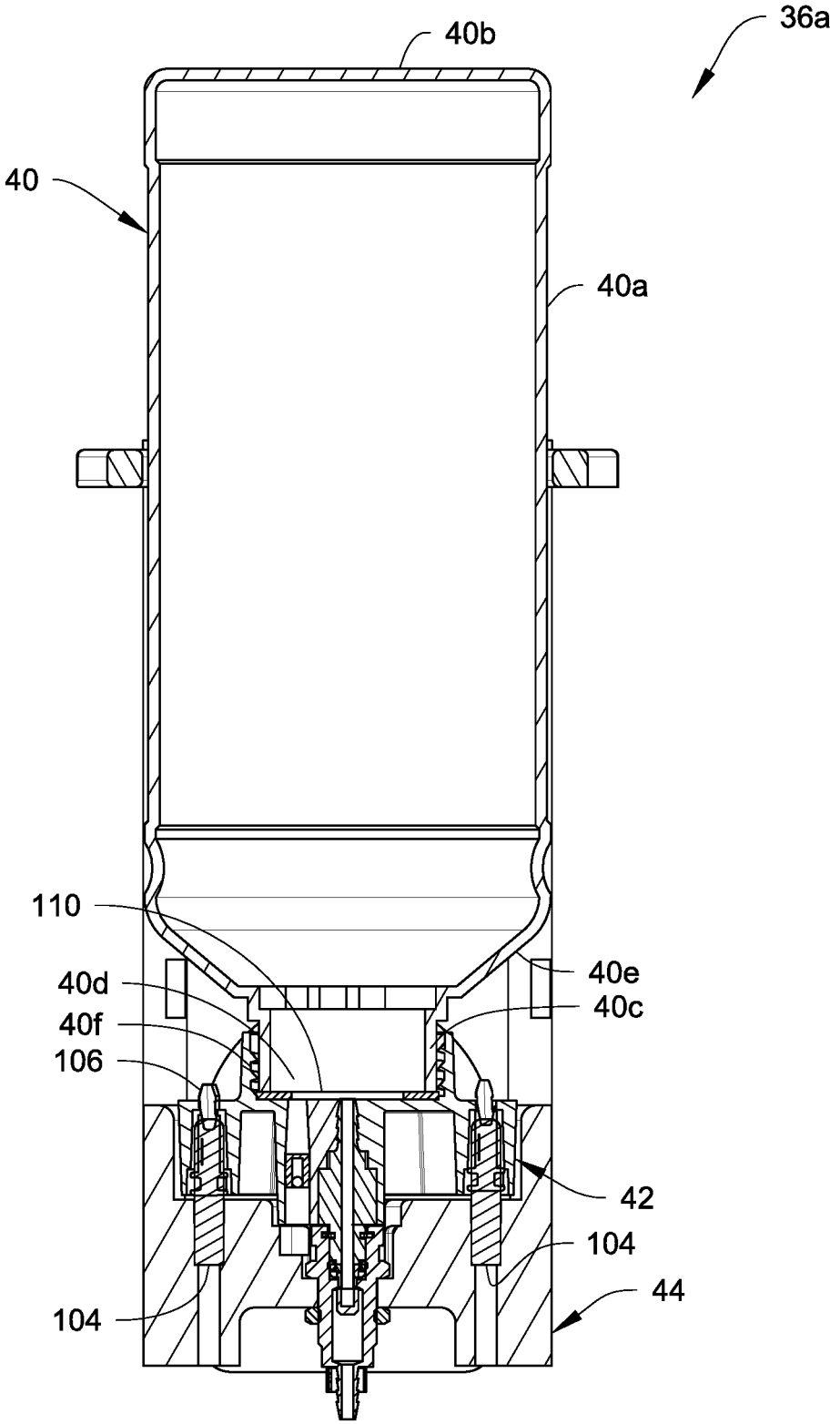
FIG. 5 is a longitudinal cross-sectional view of the cap and bottle assembly and receiver taken along line 5-5 of FIG. 3.

Referring to FIGS. 3-5, one of the ink supplies 36*a-e*, such as the ink supply 36*a*, is illustrated. The other ink supplies 36*b-e* are substantially identical in construction to the ink supply 36*a*. The ink supply 36*a* includes an ink bottle 40, a unique cap 42 secured to the bottle 40, and a receiver 44 that receives the cap 42.

In the illustrated example, the bottle 40 is the bottle that the ink comes in from the ink supplier or other retailer of the ink. The bottle 40 is longitudinally elongated and is generally cylindrical in construction with a length greater than its maximum diameter. The bottle 40 includes a body 40*a* with a closed end 40*b*, a neck 40*c* defining an ink outlet 40*d* (best seen in FIG. 5) at an end opposite the closed end 40*b*, and a shoulder 40*e* between the neck 40*c* and the body 40*a*. The neck 40*c* has an exterior surface with affixing means, such as threads 40*f*, thereon for affixing the cap 42 to the bottle 40. The interior of the bottle 40 contains an ink that is suitable for use with the DOD card printer 12, and the ink has a color that is intended to be used with the particular print head 26*a*.

The cap 42 is configured to be affixed to the bottle 40, in particular to the neck 40*c*, once the original cap that is detachably secured to the neck 40*c* is removed. Alternatively, the cap 42 could be attached to the bottle 40 during the manufacturing process and thus in this instance the cap 42 could also be considered the original cap. The cap 42 is provided with affixing means that can engage with the affixing means on the neck 40*c* to affix the cap 42 to the neck 42. For example, the cap 42 can include threads that engage with the threads 40*f* on the neck 40*c*. The cap 42 can be made of any suitable material, for example from plastic, and the cap 42 is configured to be keyed to the specific color of ink contained within the bottle 40. For example, the cap 42 can include mechanical keying features (described further below) that are specific to the color of ink contained within the bottle 40. The mechanical keying features may be modifiable, or fixed or unchangeable. The cap 42 may also be color coded to denote the color of ink contained within the bottle 40.

The receiver 44 is part of the DOD card printer 12 and is designed to receive the cap 42 when mounting the bottle 40 in the DOD card printer 12. The receiver 44 includes a recessed mounting location 44*a* in which the cap 42 can fit. As described in further detail below, the mounting location 44*a* includes mechanical keying features that interact with the mechanical keying features on the cap 42 to dictate whether or not the cap 42 correctly fits within the mounting location 44*a*.

The receiver 44 further includes a quick-connect coupler 44*b* (see FIG. 6) mounted thereon that interacts with a quick-connect valve on the cap 42 described below. In the illustrated example, the quick-connect coupler 44*b* is a female quick-connect coupler that in use detachably connects to the quick-connect valve, which can be a male quick-connect valve, on the cap 42. A suitable quick-connect coupler and quick-connect valve is available from Colder Products company of St. Paul, Minn.

Returning to FIGS. 3-5, to help guide the bottle 40 and the cap 42 into position relative to the receiver 44, a guide 46 can be fixed to the receiver 44. The guide 46 can be a ring or partial ring that is spaced from the receiver 44 by one or more stand-offs 48. During installation of the bottle 40, the cap 42 and the bottle 40 are inserted through the upper end of the guide 46 and then slid down toward the receiver 44. When correctly installed, the body 40*a* of the bottle 40 is generally surrounded by the guide 46 to help stabilize and support the bottle 40 during use.

Figure 7:
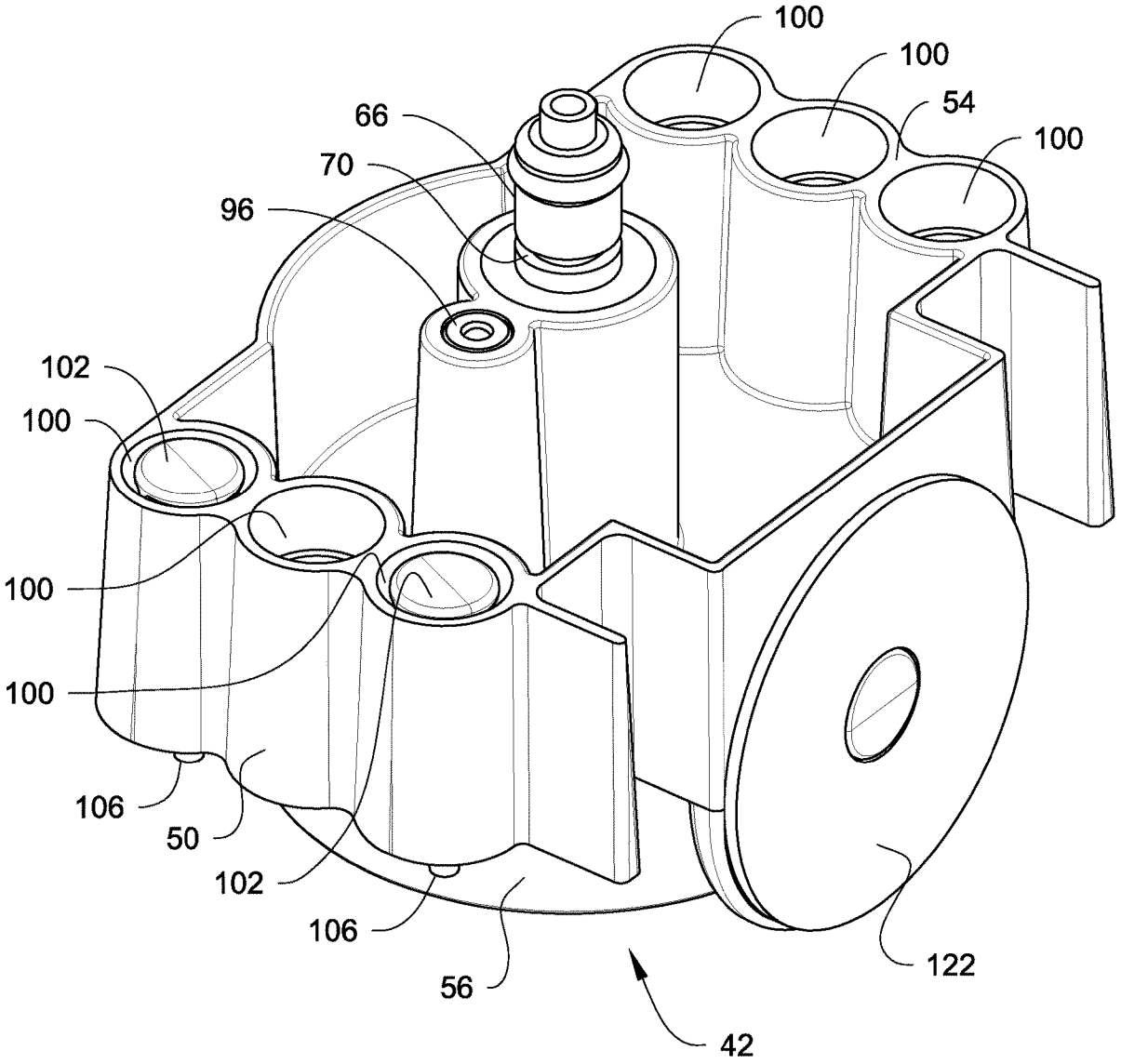
FIG. 7 is a bottom perspective view of the cap.
Figure 8:
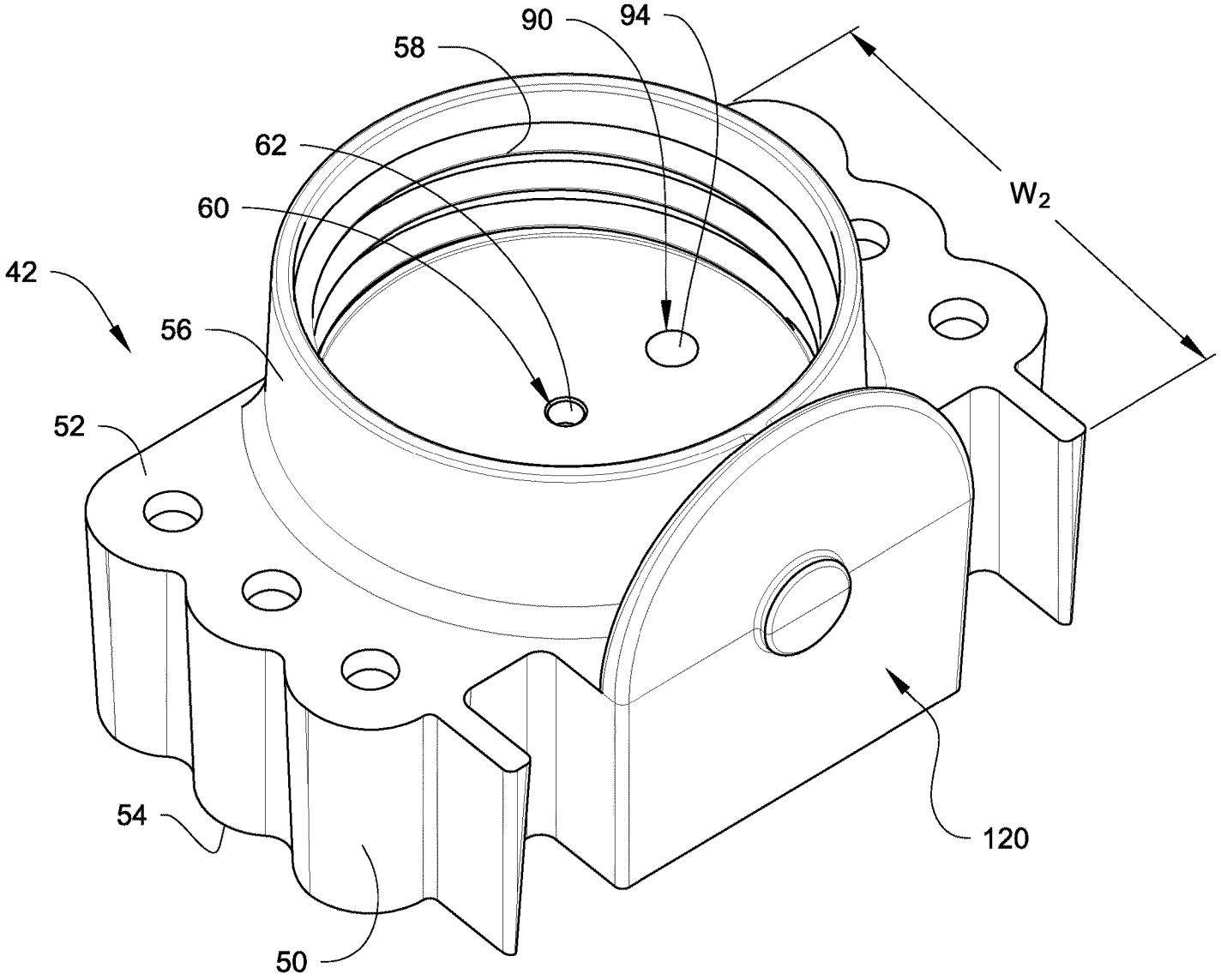
FIG. 8 is a top perspective view of the cap.
Figure 9:
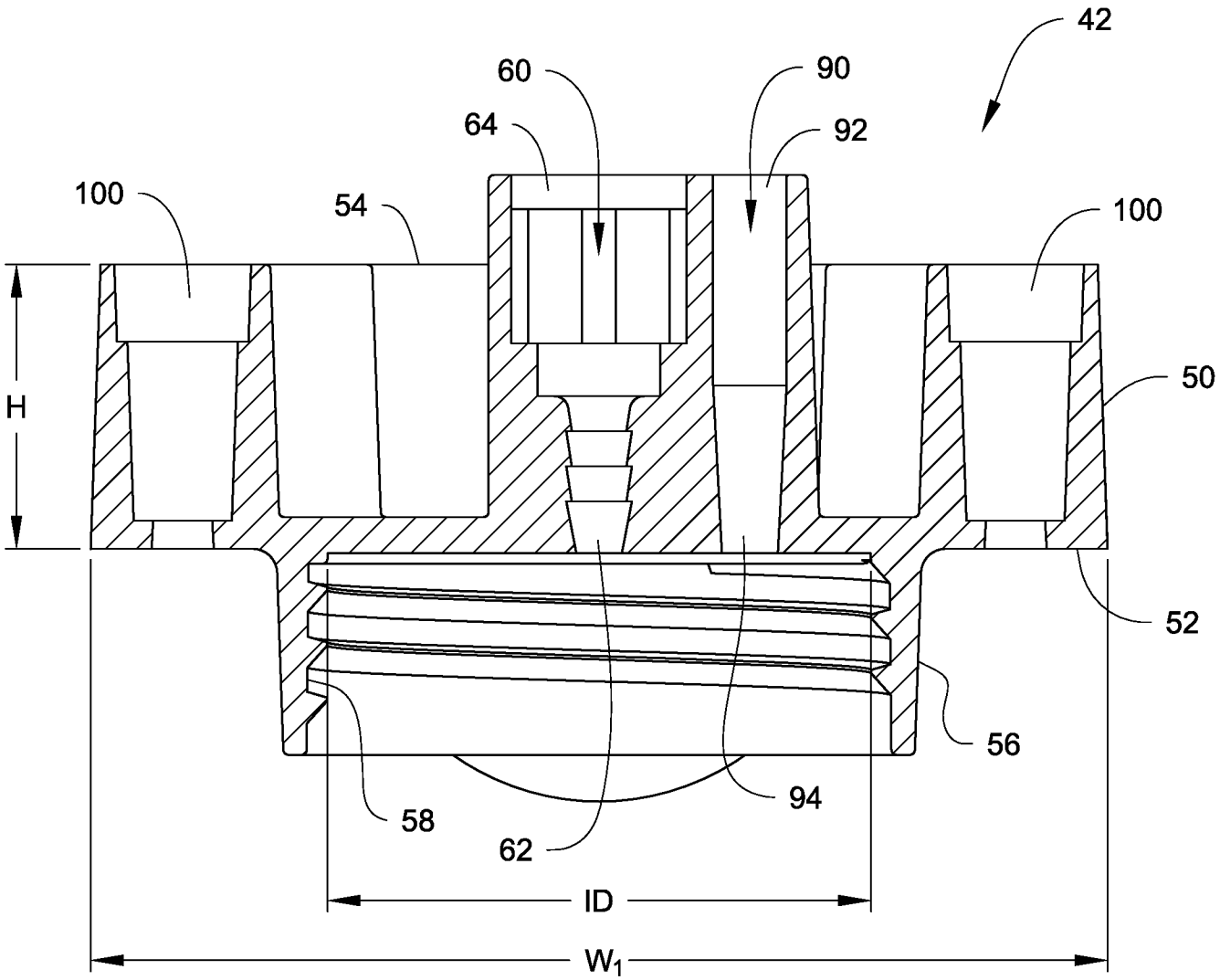
FIG. 9 is a cross-sectional view of the cap taken along line 9-9 of FIG. 8 with the valves of the cap removed.

Referring to FIGS. 7-9, an example of the cap 42 is illustrated. The cap 42 includes a cap body 50 having a first end 52 and a second end 54. When the cap 42 is in use and mounted in the receiver 44, the first end 52 may be referred to as a top end and the second end 54 may be referred to as a bottom end. A cylindrical connection sleeve 56 projects from the first end 52 which is used to connect the cap 42 to the neck 40*c* of the bottle 40. An interior surface of the sleeve 56 includes affixing means, such as threads 58, thereon that are configured to engage with the affixing means, such as the threads 40*f*, on the neck 40*c* of the bottle 40. In this example, the cap 42 can be affixed to the neck 40*c* of the bottle 40 by threading the sleeve 56 onto the neck 40*c*.

An ink passage 60 is formed through the cap body 50 to allow passage of ink from the bottle 40 through the cap body 50. The ink passage 60 has an ink passage inlet end 62 formed in the first end 52 within the connection sleeve 56 and an ink passage outlet end 64 in the second end 54. A quick-connect valve 66 is disposed in the ink passage 60 to control the flow of ink through the ink passage 60 from the ink passage inlet end 62 to the ink passage outlet end 64. The quick-connect valve 66 is a male quick-connect valve that is configured to couple to the female quick-connect coupler 44*b* of the receiver 44 when the cap 42 is correctly mounted in the receiver 44. In addition, the female quick-connect coupler 44*b* of the receiver 44 is configured to automatically open the quick-connect valve 66 to permit the flow of ink through the ink passage 60. This type of quick-connect coupler 44*b* and quick-connect valve 66 are available from Colder Products company of St. Paul, Minn.

Figure 6:
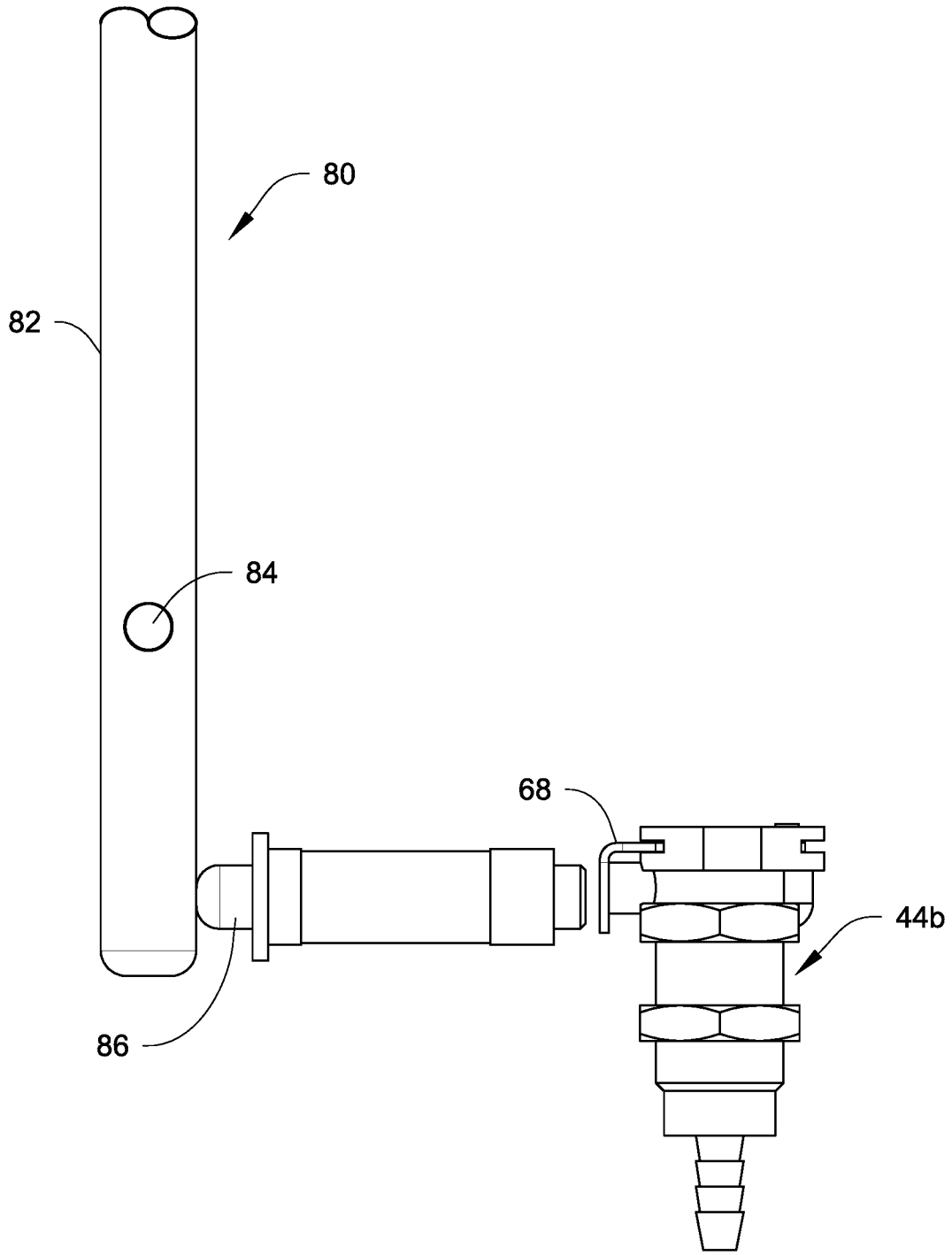
FIG. 6 illustrates components of a quick-connect valve release mechanism.

Referring to FIG. 6, the female quick-connect coupler 44*b* can include a releasable spring biased latch 68 that is configured to engage within a slot 70 formed in the male quick-connect valve 66 (shown in FIG. 7) which locks the female quick-connect coupler 44*b* and the male quick-connect valve 66 to one another. To release the connection between the female quick-connect coupler 44*b* and the male quick-connect valve 66, a release mechanism 80 can be provided on the receiver 44. Referring to FIGS. 3, 4 and 6, in the illustrated example, the release mechanism 80 is a manual release mechanism that includes a lever 82 that is pivoted to the retainer 44 via a pivot pin 84. A pin 86 is spring-loaded to the left in FIG. 6 into engagement with the end of the lever 82. An opposite end of the pin 86 is disposed adjacent to the latch 68. When the lever 82 is pivoted in a counterclockwise direction in FIG. 6, the end of the lever 82 forces the pin 86 to the right which pushes the latch 68 inward to permit disengagement between the female quick-connect coupler 44*b* and the male quick-connect valve 66.

Returning to FIGS. 7-9, a vent passage 90 is formed through the cap body 50 separate from the ink passage 60. The vent passage 90 permits venting by allowing air into the bottle 40 through the vent passage 90 to facilitate the flow of ink through the ink passage 60. The vent passage 90 has a vent passage inlet end 92 formed in the second end 54 and a vent passage outlet end 94 in the first end 52 within the connection sleeve 56. A check valve 96 (see FIG. 7) is provided in the vent passage 90, for example at or near the vent passage inlet end 92, that controls the flow of air through the vent passage 90 from the vent passage inlet end 92 to the vent passage outlet end 94. The check valve 96 can have any construction that automatically controls the flow of air through the vent passage 90. An example of a suitable check valve that can be used is available from Lee Company, part number CCP15510004S.

Figure 10:
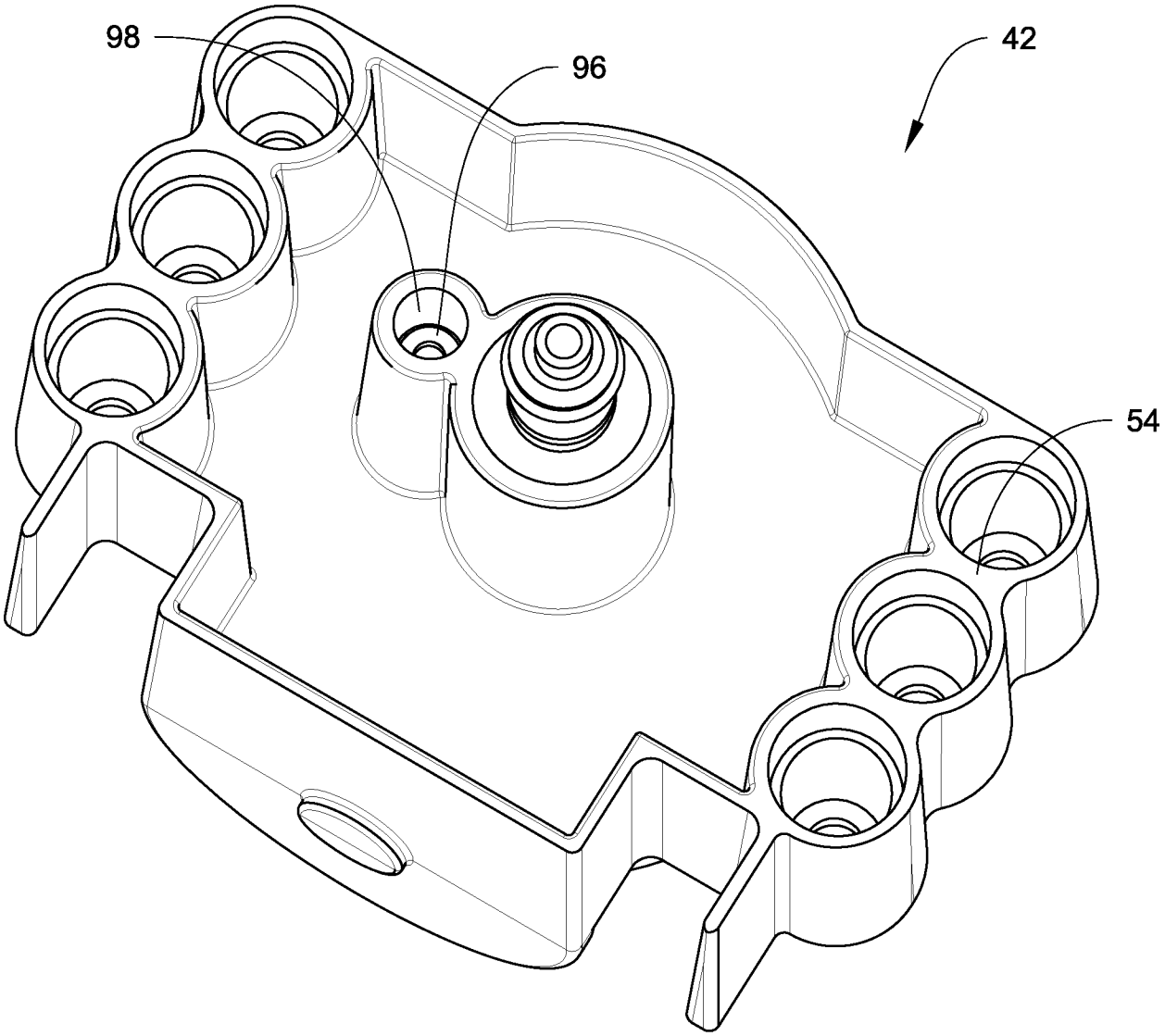
FIG. 10 is a perspective view of another embodiment of a cap with a recessed check valve.
Figure 11:
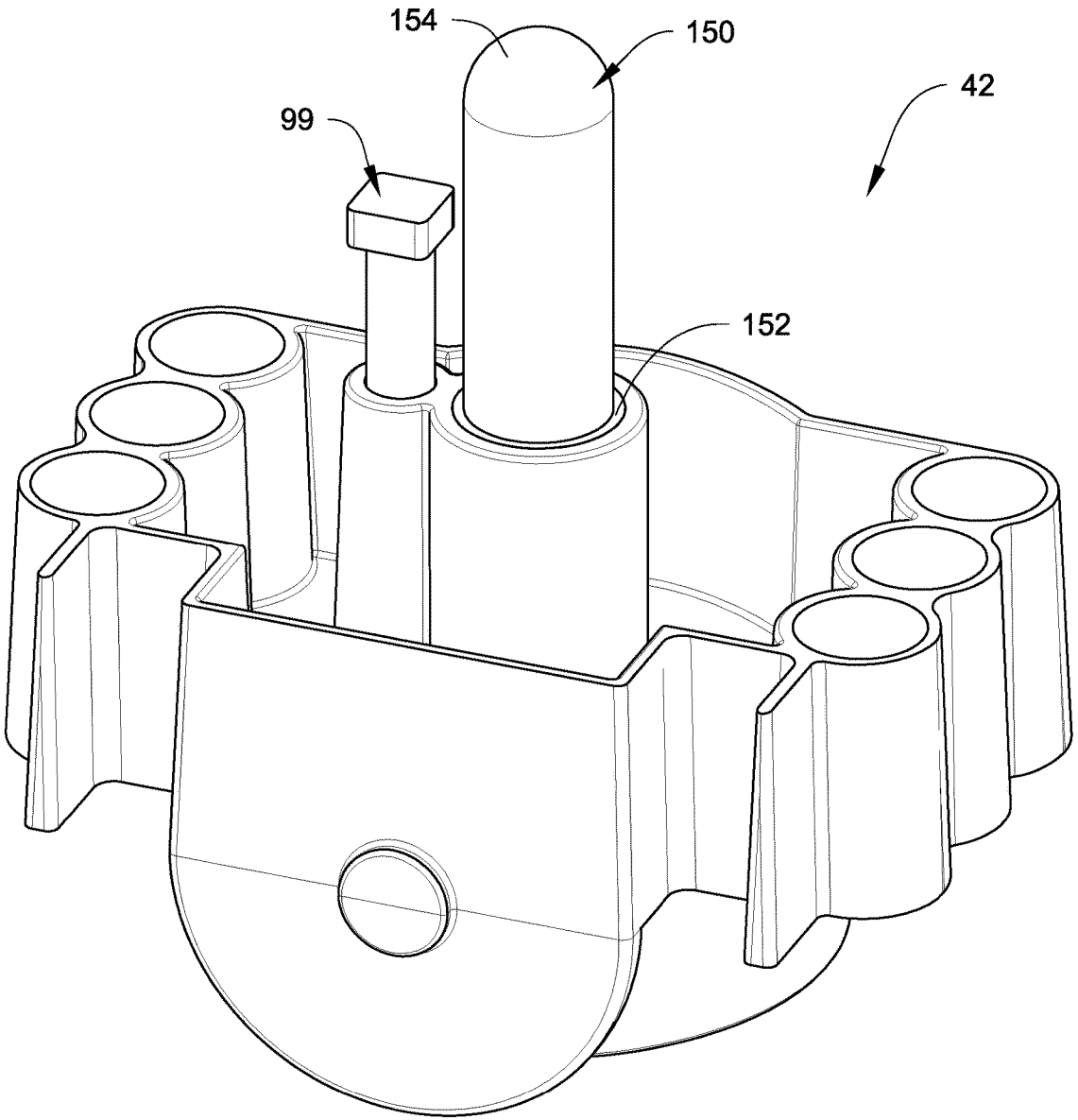
FIG. 11 is a perspective view of the cap of FIG. 10 prior to use.
Figure 12:
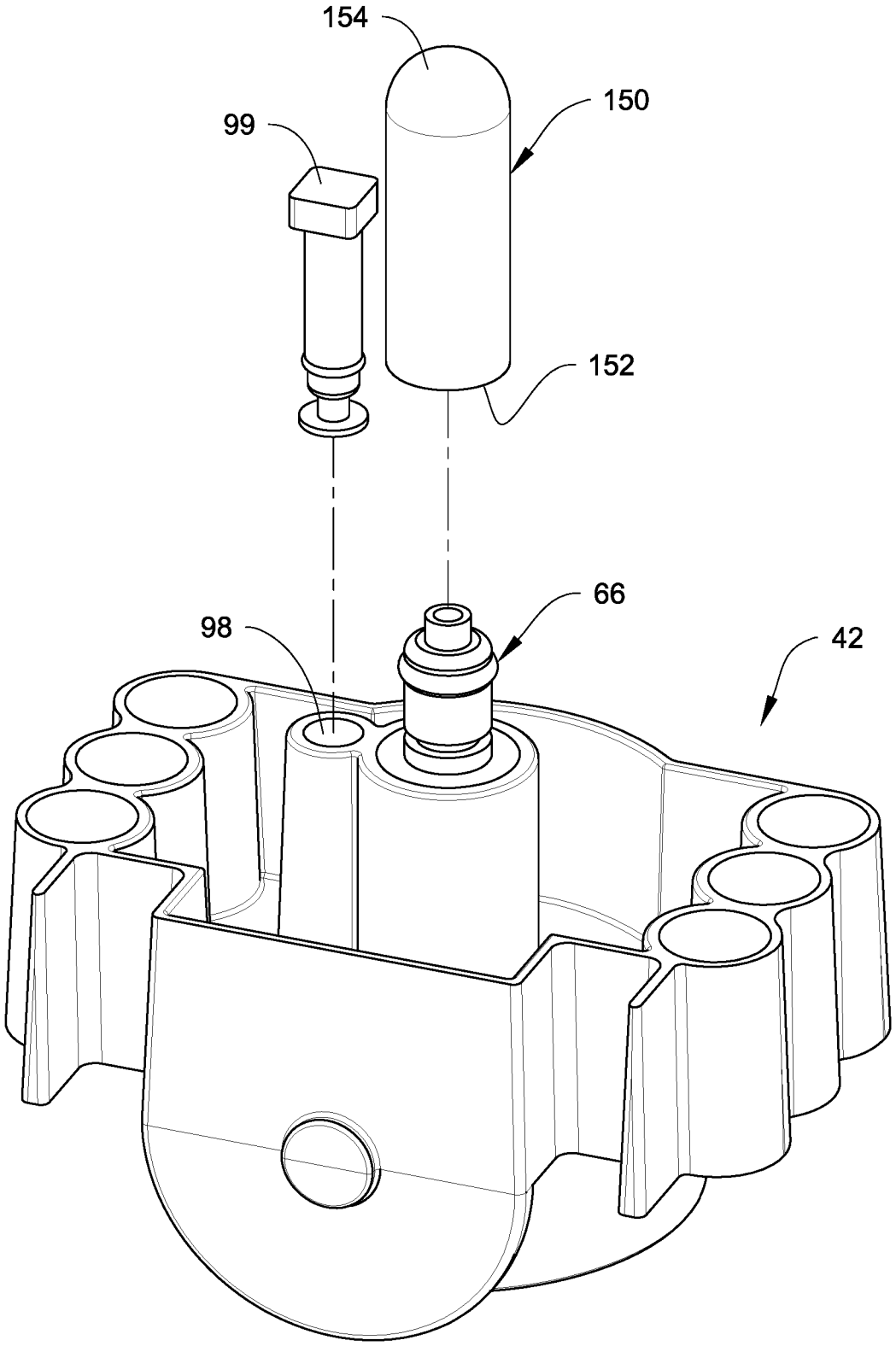
FIG. 12 is a view similar to FIG. 11 but showing the plug and seal of FIG. 11 in an exploded position.

An alternative embodiment of the cap 42 is illustrated in FIGS. 10-12. FIG. 7 illustrates the end of the check valve 96 as being substantially flush with the surface at the second end 54. However, in FIG. 10, the check valve 96 is illustrated as being recessed within the vent passage 90 so that the end of the check valve 96 is recessed from the surface of the second end 54. This recessing of the check valve 96 forms a space 98 between the surface at the second end 54 and the end of the check valve 96.

Referring to FIGS. 11 and 12, the space 98 permits insertion of an end of a removable plug 99 into the vent passage 90. The plug 99 seals the vent passage 90 during shipping and prior to installation into the printer, thereby preventing leakage of the ink through the vent passage 90. When it comes time to install the bottle, the plug 99 is removed. The plug 99 can be made of any material that is compatible with and can withstand UV ink or any other type of ink within the bottle. For example, the plug 99 can be made of silicone rubber or ethylene propylene rubber. Other forms of seals for sealing the vent passage 90 in the cap 42 in either FIGS. 7-9 or FIG. 10 can also be used.

FIGS. 11-12 also illustrates a removable seal 150 that can be used to seal the male quick-connect valve 66 during shipping and prior to installation into the printer, thereby gathering and collecting any ink that leaks from the cap 42 via the ink passage 60. The seal 150 is illustrated as a structure, such as generally cylindrical, that fits over and surrounds the valve 66 and that includes an open first end 152 and a closed second end 154. The first end 152 is releasably fixed to the cap 42, with the remainder of the seal 150 surrounding and enclosing the valve 66. The closed second end 154 acts as a reservoir to gather and collect any ink that leaks through the valve 66 or through the ink passage 60. When it comes time to install the bottle, the seal 150 is removed. The seal 150 can be made of any material that is compatible with and can withstand UV ink or any other type of ink within the bottle. For example, the seal 150 can be made of silicone rubber or ethylene propylene rubber. In addition, the seal 150 can be made visually clear, for example transparent or translucent, to visually show before removing the seal 150 any leakage of ink that may have occurred. Only a portion of the seal 150, such as the portion near the closed second end 154, can be made visually clear, or the entire seal 150 can be made visually clear.

The cap 42 further includes one or more mechanical keying features that dictate whether or not the cap 42 correctly fits within the mounting location 44*a* of the receiver 44. For example, with reference to FIG. 7, the one or more mechanical keying features can comprise a plurality of bores 100 formed in the cap body 50 at the second end 54. The bores 100 are configured to receive keying pins 102 that can be installed within the bores 100. Two of the keying pins 102 are illustrated in FIG. 7 installed in two of the bores 100. When a keying pin 102 is received in one of the bores 100, the keying pin 102 effectively blocks the bore 100. In addition, referring to FIG. 5, the receiver 44 can include one or more keying pins 104 that are fixed to the receiver 44 and project upwardly therefrom within the recessed mounting location 44*a* for being received within the bores 100 that are not blocked by the keying pins 102. Preferably, the number and locations of the keying pins 104 corresponds to the number and locations of the unblocked bores 100. As a result, only a cap 42 with the correct arrangement of the keying pins 102 and the unblocked bores 100 can be installed in the recessed mounting location 44*a* of the receiver 44.

As best seen in FIGS. 5, 7 and 9, the bores 100 preferably extend from the second end 54 and through the first end 52 of the cap 42. This permits an end 106 of each of the keying pins 102 to project above the first end 52, providing a visual indicator to indicate the locations of the keying pins 102.

As depicted in FIG. 7, three of the bores 100 can be provided on one side of the cap 42 and three of the bores 100 can be provided on the other side of the cap 42. On each side of the cap, the three bores 100 can be disposed along a straight line with the straight lines parallel to one another. However, a smaller or larger number of the bores 100 can be used, and other arrangements of the bores 100 are possible.

Figure 15:
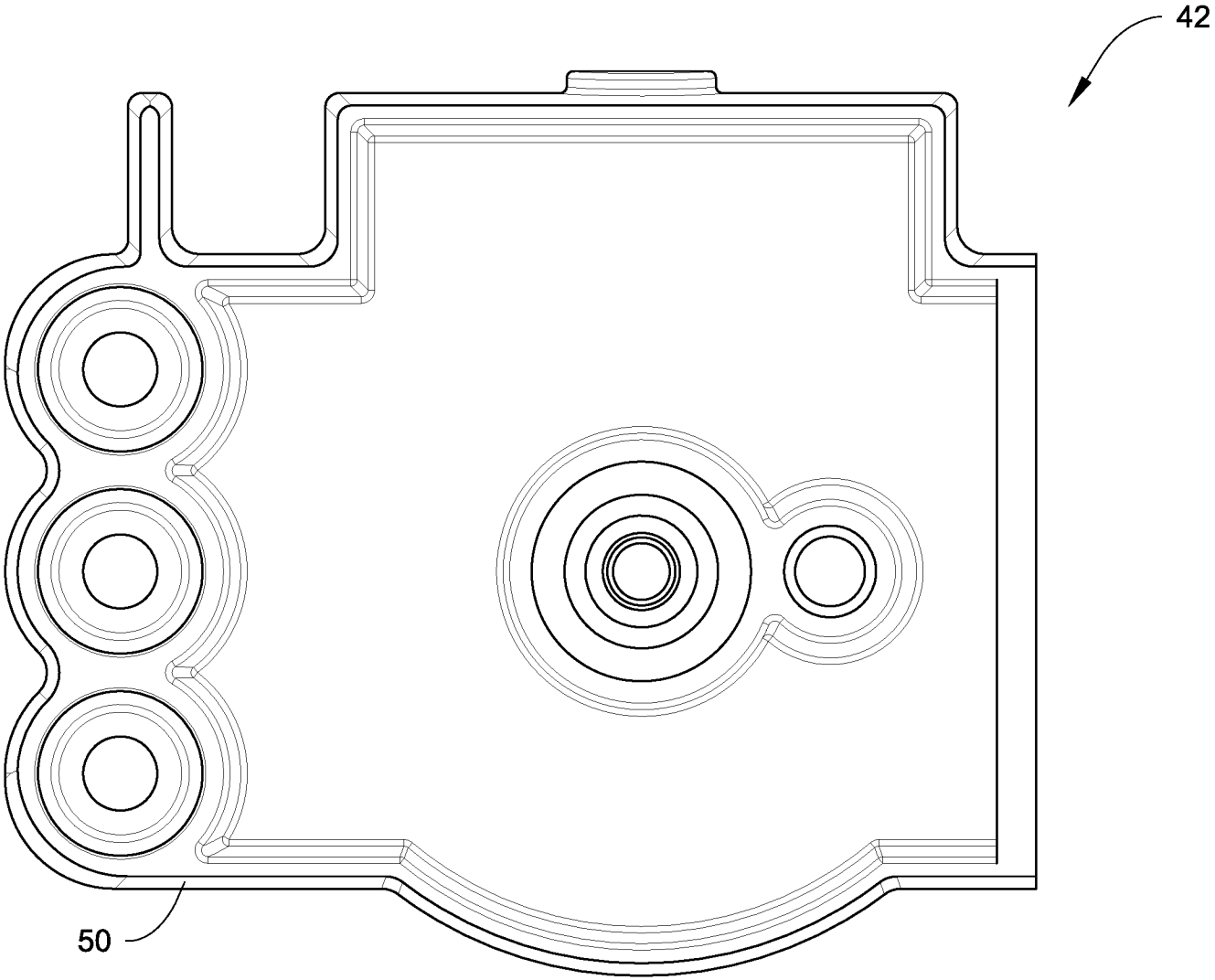
FIG. 15 illustrates an embodiment of the cap where an outer periphery of the body of the cap forms the mechanical keying feature.
Figure 16:
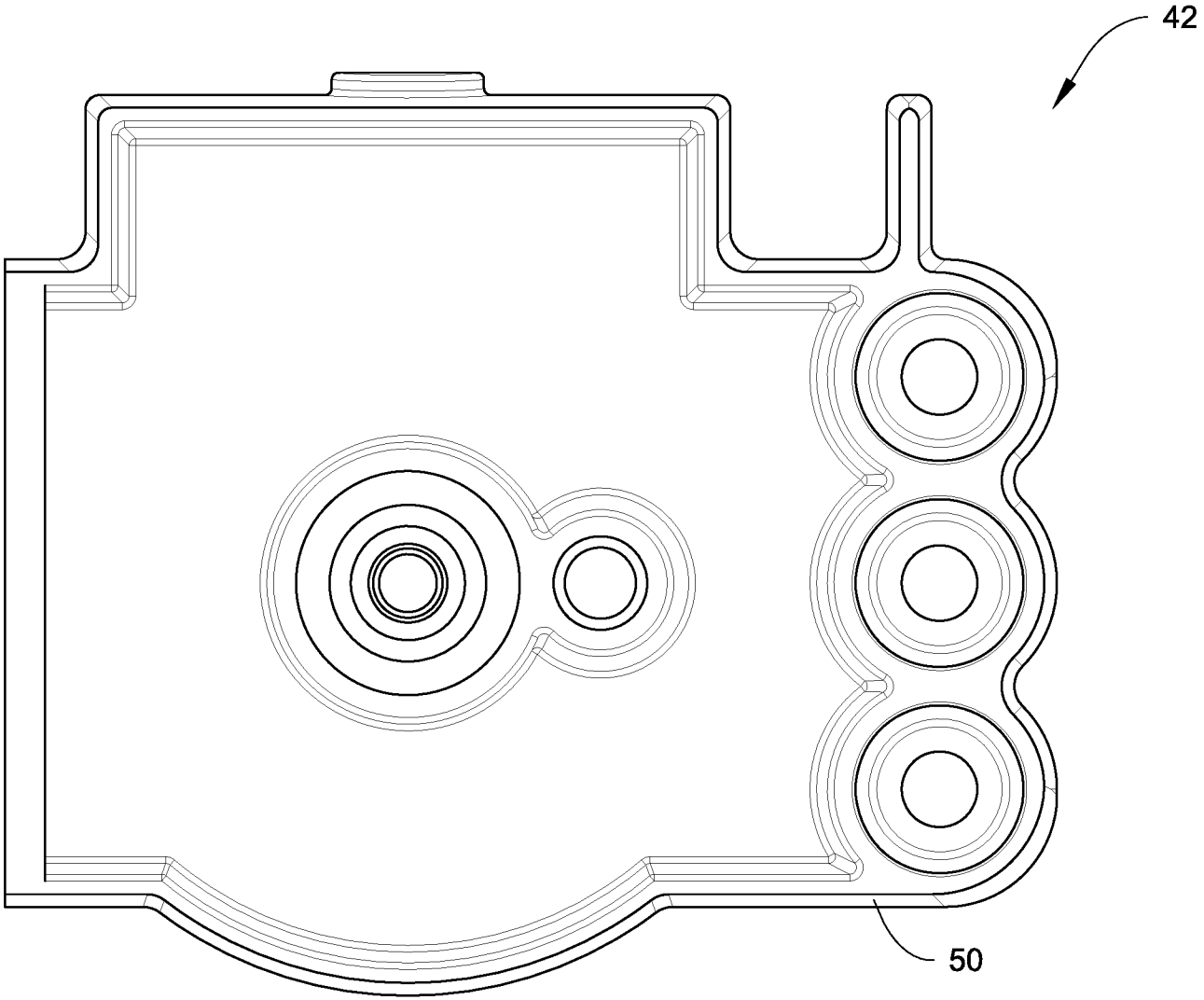
FIG. 16 illustrates another embodiment of the cap where an outer periphery of the body of the cap forms the mechanical keying feature.

FIGS. 15 and 16 illustrate another example of mechanical keying features. In these examples, the shape of an outer periphery of the cap body 50 forms the mechanical keying feature. The shape of the outer periphery of the cap body 50 can be specific to, and signify, the color of ink contained in the bottle. So the shape of the outer periphery of the cap body 50 can be made different for each cap 42. The recessed mounting location 44*a* of the receiver 44 (see FIG. 3) can have an inner periphery shape that matches the shape of the outer periphery of the cap body 50 so that only a cap 42 with the correct outer periphery shape can be mounted in the receiver 44.

In the example of the cap 42 illustrated in FIG. 15, the row of bores on the right side of the cap body 50 (in the bottom view of FIG. 15) are shown as being removed and the right side of the cap body 50 is illustrated as being substantially flat. This shape of the outer periphery of the cap body 50 can signify and be assigned to a particular color of ink, and the cap body 50 can be received in a recessed mounting location 44*a* of the receiver 44 that has a corresponding shape. In the example of the cap 42 illustrated in FIG. 16, the row of bores on the left side of the cap body 50 (in the bottom view of FIG. 16) are shown as being removed and the left side of the cap body 50 is illustrated as being substantially flat. This shape of the outer periphery of the cap body 50 can signify and be assigned to a particular color of ink different than the cap body 50 in FIG. 15, and can be received in a recessed mounting location 44*a* of the receiver 44 that has a corresponding shape. The construction and features of the caps 42 in FIGS. 15 and 16 can be otherwise identical to the construction and features of the cap 42 illustrated in FIGS. 7-9. The specific shapes of the outer periphery of the cap body 50 shown in FIGS. 15 and 16 are examples only. Many different outer periphery shapes can be used to form the mechanical keying feature. In addition, the outer periphery shape can be used together with the keying pins 102 described above.

Figure 13:
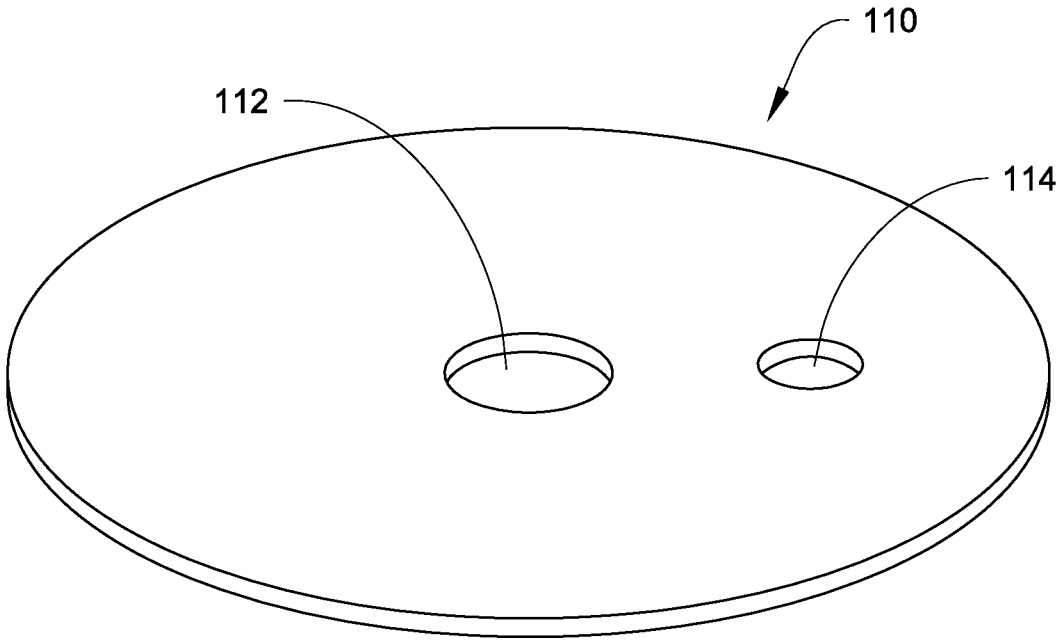
FIG. 13 is a perspective view of a cap liner used in the cap.

Referring to FIGS. 5 and 13, the cap 42 may further include a cap liner 110 within the sleeve 56 at the base of the sleeve 56 and on first surface 52. The cap liner 110 can be made from a compressible material including, but not limited to, compressible foam or ethylene propylene diene monomer (EPDM) rubber. In some embodiments, the cap liner 110 can comprise an EPDM rubber having a durometer from about 40 to about 70. The cap liner 110 is intended to interface and seal with the end of the bottle 40. The cap liner 110 can have a circular shaped-perimeter with a diameter approximately equal to the interior diameter of the sleeve 56. Accordingly, the entire end of the bottle 40 seals with the cap liner 110 when the cap 42 is fully installed on the bottle 40. The cap liner 110 can be provided with a passageway 112 therethrough that is aligned with the ink passage 60 to permit passage of ink through the cap liner 110, and a passageway 114 therethrough that is aligned with the vent passage 90 to permit passage of air through the cap liner 110. Although FIG. 13 illustrates the separate passageways 112, 114, the passageways 112, 114 could be combined into a single passageway.

Figure 14:
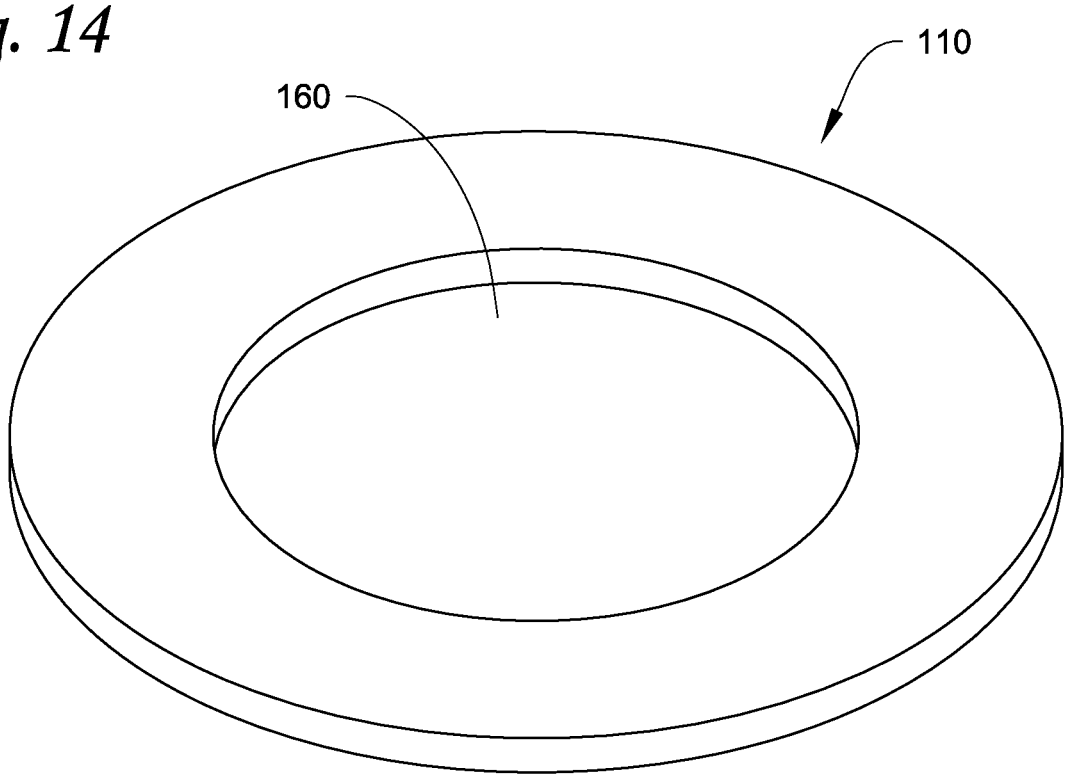
FIG. 14 is a perspective view of another embodiment of a cap liner that can be used in the cap.

Another embodiment of the cap liner 110 is illustrated in FIG. 14. In this embodiment, the cap liner 110 is shown as being donut-shaped with a circular shaped-perimeter having a diameter approximately equal to the interior diameter of the sleeve 56, and a single passageway 160 therethrough. The entire end of the bottle 40 seals with the cap liner 110 when the cap 42 is fully installed on the bottle 40, and the single passageway 160 permits passage of ink through the cap liner 110 via the ink passage 60 and passage of air through the cap liner 110 via the vent passage 90.

Returning to FIGS. 7 and 8, the cap 42 includes an RFID tag mounting surface 120 on a side thereof. An RFID tag 122 is mounted on the mounting surface 120, and a reader/writer 124 (FIG. 3) that reads data from and/or writes data to the RFID tag 122 is mounted on the receiver 44 or elsewhere in the DOD card printer 12. The mounting surface 120 can be flat and oriented vertically during use in order to correctly position the RFID tag 122 relative to the reader/writer 124. The RFID tag 122 can store data such as the type and color of ink in the bottle 40, the manufacturer of the ink, the date the ink was manufactured, a "use by" date of the ink, suggested operational parameters of the DOD card printer 12 based on the ink, an estimated amount of ink in the bottle 40, and other data. Some of the data on the RFID tag 122 may also be updated during use of the DOD card printer 12. If the reader/writer 124 determines that the wrong bottle is present based on reading data from the RFID tag 122, the DOD card printer 12 can be prevented from operating and an error message can be displayed on a suitable display of the system 10. In the illustrated example, the RFID tag 122 is generally ring or donut shaped. An example of a ring-shaped RFID tag is disclosed in U.S. Pat. No. 6,963,351 the entire contents of which are incorporated herein by reference.

Referring to FIGS. 3-5, a sensor 130 may be provided to sense ink within the bottle 40. The sensor 130 can be any sensor that is suitable for sensing ink within the bottle 40. For example, the sensor 130 can be a capacitance sensor. The sensor 130 can be mounted on the receiver 44 or elsewhere on the DOD card printer 12. The sensor 130 can be positioned near the shoulder **40*e* of the bottle 40. The sensor 130 senses the ink in the bottle 40 at the location of the shoulder 40*e*. If the ink level drops below the shoulder 40*e*, the sensor 130 no longer senses the ink and a signal can be sent to a controller to indicate that the ink in the bottle 40** is running low and needs to be replaced.

When designed for use in the DOD card printer 12, the cap 42 can have various dimensions that are unique to such an application. For example, referring to FIG. 9, the sleeve 56 can have an inner diameter ID of about 1.5 inches or more (about 3.81 cm or more); the cap body 50 can have a height H of about 0.81 inches or more (about 2.06 cm or more) measured between the first end 52 and the second end 54; the cap body 50 can have a major width $W_1$ of about 2.7 inches or more (about 6.9 cm or more); and a minor width $W_2$ (see FIG. 8) of about 1.8 inches or more (about 4.6 cm or more). However, other dimensions are possible.

When UV curable ink is used for the printing, the card processing system 10 described herein may be configured as what may be referred to as a desktop card processing system. Such a desktop card processing system would include at least a card input and a card output (which may be at opposite ends of the system or at the same end of the system), a DOD card printer that prints on the cards using UV curable ink, and a UV cure station for curing the UV curable ink applied to the card. Additional card processing systems, such as those described above, may also be included. A desktop card processing system is typically designed for relatively small scale, individual card processing. In desktop processing systems, a single card to be processed is input into the system, processed, and then output. These systems are often termed desktop machines or desktop printers because they have a relatively small footprint intended to permit the machine to reside on a desktop. Many examples of desktop machines are known, such as the SD or CD family of desktop card machines available from Entrust Datacard Corporation of Shakopee, Minn. Other examples of desktop card machines are disclosed in U.S. Pat. Nos. 7,434,728 and 7,398,972, each of which is incorporated herein by reference in its entirety.

Additional aspects of the described apparatus, systems and methods include a DOD printing system with a drop-on-demand printer that is configured to print on a substrate using ultraviolet curable ink. The drop-on-demand printer can include at least one drop-on-demand print head, an ink bottle mounted in the drop-on-demand printer and fluidly connected to the at least one drop-on-demand print head, the ink bottle having a neck defining an ink outlet, and the neck having an exterior surface with affixing means, such as threads, thereon. A unique cap is provided with affixing means, such as threads, that are engageable with the affixing means on the neck to secure the cap to the bottle. The cap includes a mechanical keying feature and/or a quick-connect valve that controls flow of ink from the ink bottle through an ink passage in the cap. The cap can also include a vent passage to allow air to enter the bottle.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A plastic card processing system, comprising:

a card input that is configured to hold a plurality of plastic cards to be processed;

a card output that is configured to hold a plurality of processed plastic cards;

at least one of a magnetic stripe reading/writing system and an integrated circuit chip programming system between the card input and the card output;

a drop-on-demand card printer between the card input and the card output that is configured to print on a plastic card using ultraviolet curable ink, the drop-on-demand card printer includes:

at least one drop-on-demand print head;

an ink bottle mounted in the drop-on-demand card printer and fluidly connected to the at least one drop-on-demand print head, the bottle containing ultraviolet curable ink, the ink bottle having a neck defining an ink outlet, and the neck having an exterior surface with threads thereon;

a cap affixed to the neck of the ink bottle, the cap having a connection sleeve with an interior surface with threads thereon, and the threads on the interior surface of the connection sleeve are engaged with the threads on the exterior surface of the neck;

a receiver that is configured to receive the cap when the ink bottle is mounted in the drop-on-demand card printer, the receiver having a quick connect coupler;

the cap includes a quick connect valve that is connected with the quick connect coupler of the receiver; and a manual release mechanism mounted in the drop-on-demand card printer that is engageable with the quick connect coupler to permit manual release of the connection between the quick connect valve and the quick connect coupler;

an ultraviolet curing station between the card input and the card output, the ultraviolet curing station is configured to cure ultraviolet curable ink applied to a plastic card by the drop-on-demand card printer.

2. The plastic card processing system of claim 1, wherein the drop-on-demand card printer further includes a receiver that is configured to receive the cap when the ink bottle is mounted in the drop-on-demand card printer, and the cap includes a mechanical keying feature that limits mounting of the cap to the receiver.

3. The plastic card processing system of claim 2, wherein the ink bottle further includes a shoulder, and further comprising a capacitance sensor mounted on the receiver and positioned adjacent to the shoulder when the ink bottle is mounted in the drop-on-demand card printer.

4. The plastic card processing system of claim 2, wherein the cap includes a cap body with a first end and a second end, the connection sleeve projects from the first end; and the mechanical keying feature comprises a plurality of bores formed in the cap body at the second end.

5. The plastic card processing system of claim 2, wherein the mechanical keying feature comprises a shape of an outer periphery of the cap, and the receiver has a shape that is configured to match the shape of the outer periphery of the cap.

6. The plastic card processing system of claim 1, wherein the cap includes a quick-connect valve that controls flow of the ultraviolet curable ink from the ink bottle through an ink passage in the cap, and the cap further includes a check valve adjacent to the quick-connect valve that provides venting by allowing air into the ink bottle through a vent passage in the cap.

7. The plastic card processing system of claim 6, further comprising a cap liner within the cap at a base end of the connection sleeve that is configured to seal with an end of the neck of the ink bottle, and the cap liner is configured to permit passage of the ultraviolet curable ink through the cap liner and permit passage of air through the cap liner.

8. The plastic card processing system of claim 1, further comprising a radio frequency identification tag mounted on the cap.

9. The plastic card processing system of claim 1, wherein the drop-on-demand card printer includes:

a plurality of the drop-on-demand print heads;

a plurality of the ink bottles mounted in the drop-on-demand card printer, each ink bottle contains ultraviolet curable ink, each ink bottle is fluidly connected to a corresponding one of the drop-on-demand print heads via a pump, each ink bottle having a neck defining an ink outlet, and each neck having an exterior surface with threads thereon.

10. The plastic card processing system of claim 1, wherein the cap includes a non-circular cap body, and the connection sleeve extends from the non-circular cap body.

11. A card processing system, comprising:

a card input that is configured to hold a plurality of cards to be processed;

a card output that is configured to hold a plurality of processed cards;

at least one of a magnetic stripe reading/writing system and an integrated circuit chip programming system between the card input and the card output;

a drop-on-demand card printer between the card input and the card output that is configured to print on a card using ultraviolet curable ink, the drop-on-demand card printer includes:

at least one drop-on-demand print head;

an ink bottle mounted in the drop-on-demand card printer and fluidly connected to the at least one drop-on-demand print head, the ink bottle having a neck defining an ink outlet, and the neck having an exterior surface with threads thereon;

a cap affixed to the neck of the ink bottle, the cap having a connection sleeve with an interior surface with threads thereon, and the threads on the interior surface of the connection sleeve are engaged with the threads on the exterior surface of the neck;

the cap includes a quick-connect valve that controls flow of ink from the ink bottle through an ink passage in the cap, and the cap further includes a check valve adjacent to the quick-connect valve that provides venting by allowing air into the ink bottle through a vent passage in the cap;

a removable plug disposed in the vent passage to seal the vent passage, and a removable seal fixed to the cap and surrounding the quick-connect valve;

an ultraviolet curing station between the card input and the card output, the ultraviolet curing station is configured to cure ultraviolet curable ink applied to a card by the drop-on-demand card printer.

12. A system, comprising:

a plastic card processing system that includes:

a card input that is configured to hold a plurality of plastic cards to be processed;

a card output that is configured to hold a plurality of processed plastic cards;

at least one of a magnetic stripe reading/writing system and an integrated circuit chip programming system between the card input and the card output;

a drop-on-demand card printer between the card input and the card output that is configured to print on a plastic card using ultraviolet curable ink, the drop-on-demand card printer includes:

at least one drop-on-demand print head;

a receiver having a non-circular recessed mounting location that is configured to receive a cap of an ink bottle, the receiver is fluidly connected to the at least one drop-on-demand print head;

an ultraviolet curing station between the card input and the card output, the ultraviolet curing station is configured to cure ultraviolet curable ink applied to a plastic card by the drop-on-demand card printer; and a cap and bottle assembly mountable in the drop-on-demand card printer; the cap and bottle assembly includes an ink bottle and a cap; the ink bottle contains ultraviolet curable ink for use in printing on the plastic card by the at least one drop-on-demand print head, the ink bottle having a neck defining an ink outlet, and the neck having an exterior surface with threads thereon; the cap is removably mounted to the neck of the ink bottle, the cap having a non-circular cap body, a connection sleeve extending from the non-circular cap body with an interior surface with threads thereon, and the threads on the interior surface of the connection sleeve are engaged with the threads on the exterior surface of the neck to removably mount the cap to the ink bottle, wherein the non-circular cap body of the cap is removably receivable in the non-circular recessed mounting of the receiver;

the cap includes a quick-connect valve that controls flow of the ultraviolet curable ink from the ink bottle through an ink passage in the cap, and the cap further includes a check valve adjacent to the quick-connect valve that provides venting by allowing air into the ink bottle through a vent passage in the cap.

13. The system of claim 12, wherein the drop-on-demand card printer includes:

a plurality of the drop-on-demand print heads;

a plurality of the receivers, each one of the receivers has a non-circular recessed mounting location that is configured to receive a cap of a corresponding ink bottle, and each one of the receivers is fluidly connected to a corresponding one of the drop-on-demand print heads.

14. The system of claim 12, further comprising a cap liner within the cap at a base end of the connection sleeve that is configured to seal with an end of the neck of the ink bottle, and the cap liner is configured to permit passage of the ultraviolet curable ink through the cap liner and permit passage of air through the cap liner.

15. The system of claim 12, further comprising a radio frequency identification tag mounted on the cap.

16. The system of claim 12, wherein the ink bottle further includes a shoulder, and further comprising a capacitance sensor mounted on the receiver and positioned adjacent to the shoulder when the ink bottle is mounted in the drop-on-demand card printer.

17. The system of claim 12, wherein the receiver includes a quick connect coupler;

the cap includes a quick connect valve that is connectable with the quick connect coupler of the receiver; and a manual release mechanism mounted in the drop-on-demand card printer that is engageable with the quick connect coupler to permit manual release of a connection between the quick connect valve and the quick connect coupler.

* * * * *